United States Patent [19]

Kaplan

[11] 3,942,851

[45] Mar. 9, 1976

[54] INDICATING STORAGE BIN

[76] Inventor: Louis Kaplan, 67-23 211th St., Bayside, N.Y. 11369

[22] Filed: Aug. 2, 1974

[21] Appl. No.: 494,129

Related U.S. Application Data

[63] Continuation-in-part of Ser. No. 304,071, Nov. 6, 1972, abandoned.

[52] U.S. Cl. ..... 312/120; 312/234; 312/328; 248/133

[51] Int. Cl.[2] ..... A47F 3/14; A47F 5/12

[58] Field of Search ..... 312/120–136, 312/327–329, 302, 234.4; 248/143, 311; 211/81, 136, 133, 80, 148, 126; 222/165, 500, 556, 557; 116/114 A

[56] References Cited

UNITED STATES PATENTS

| | | | |
|---|---|---|---|
| 252,394 | 1/1882 | Moon | 312/234.4 |
| 974,263 | 1/1910 | Hamilton | 312/328 |
| 1,253,581 | 1/1918 | Fraser | 248/137 |
| 1,291,463 | 1/1919 | Fogg et al. | 211/84 |
| 1,622,771 | 3/1927 | Davis | 312/234 X |
| 1,633,461 | 6/1927 | Sopher | 312/123 |
| 2,120,082 | 6/1938 | Anderson | 312/248 X |
| 2,610,604 | 9/1952 | Edwards | 312/234 X |
| 2,785,036 | 3/1957 | Elsden-King et al. | 312/327 |
| 2,828,928 | 4/1958 | Kollisch | 312/234.1 |
| 3,082,738 | 3/1963 | Golay | 248/141 |
| 3,193,339 | 7/1965 | Cooper | 312/123 |
| 3,298,374 | 1/1967 | Grundell | 312/184 |

FOREIGN PATENTS OR APPLICATIONS

| | | | |
|---|---|---|---|
| 276,289 | 3/1927 | Germany | 248/137 |
| 817,449 | 7/1959 | United Kingdom | 312/234.1 |

*Primary Examiner*—Paul R. Gilliam
*Assistant Examiner*—Victor N. Sakran
*Attorney, Agent, or Firm*—Bauer, Amer & King

[57] ABSTRACT

A storage bin is pivotly mounted relative to a housing so as to remain in a neutral position when empty and to be positioned at an angle with respect to a horizontal plane when either in a working position or in a storage position. When in the working position free access to the interior of the bin is possible since the forward end of the bin is tipped downwardly and the material in the bin is at the forward end. When in the storage position the front end of the bin is tipped upwardly with the material being at the rear of the bin. Indicating markers on the cabinet and the front end of each bin may be used when the bins are in the storage position for providing an approximation of the quantity of material in each bin. Since the bin will be horizontal and the front surface thereof will be readily visible, by providing a different color on the front surface of the bin and, optionally, on the bottom surface of each bin, means will be available for providing a rapid, visual indication of the approximate contents of each bin merely by glancing at the entire cabinet. In the alternative embodiment of this invention the bottom wall of the storage bin is stepped to provide a plurality of transversely and upwardly extending internal shoulders that permit an indication of a "low" quantity of articles therein when the articles are relatively lightweight and might not have sufficient mass to tip the bin. An external lip at the forward end of the bin may be used in cooperation with the indicator markers on the cabinet to provide a quick quantitative analysis of the inventory.

8 Claims, 12 Drawing Figures

FIG. 1
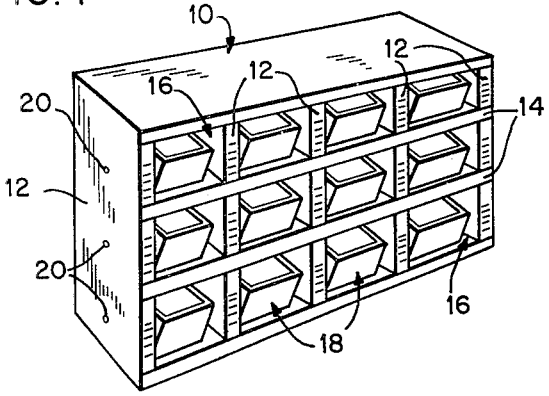
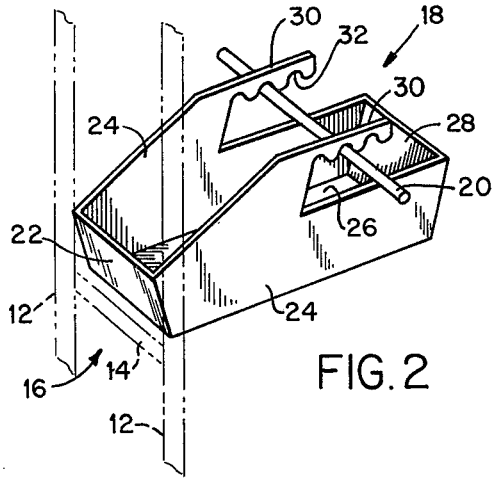
FIG. 2
FIG. 3A
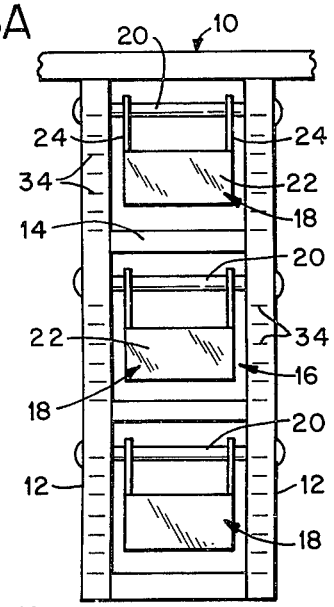
FIG. 3B
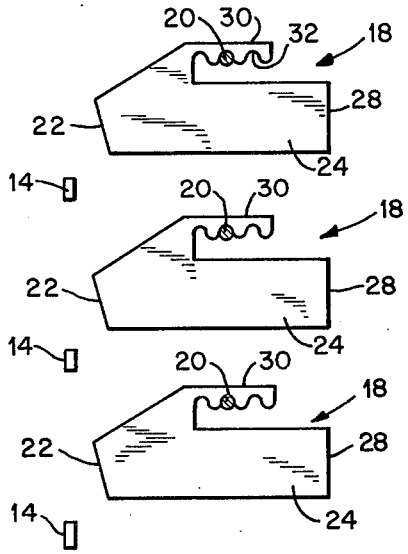
FIG. 4A
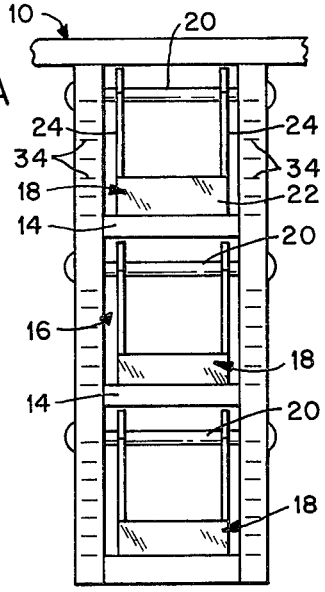
FIG. 4B
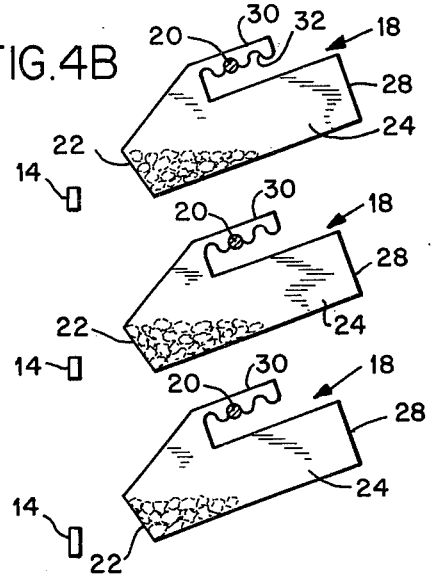

INDICATING STORAGE BIN

CROSS REFERENCE TO RELATED APPLICATION

This application is a continuation-in-part-of my copending application Ser. No. 304,071, filed Nov. 6, 1972 for an Indicating Storage Bin, which earlier filed application is now abandoned.

BACKGROUND OF THE INVENTION

1. Field of the Invention

This invention relates generally to storage bins for relatively small items such as screws, nails, nuts and bolts etc. and more particularly to an improved mounting means for the bins.

2. Description of the Prior Art

Storage bins for a wide variety of articles are notoriously old. When used for small parts such as screws, washers, nuts and bolts or the like the most common type of storage bin is merely a box that slides inwardly and outwardly of a cabinet in a horizontal plane. It is impossible to tell with the prior art whether or not the bin is full or empty or is in some state in between. That is the quantity of material in each bin cannot be determined unless the bin is pulled outwardly and this is quit troublesome particularly when a large number of different items must be stored and maintained in an inventory that must be ready for immediate use at all times. Still another type of storage bin does provide pivoting means therefore but either does not supply a cabinet for the storage bins or, where a cabinet is provided, the storage bins do not lend themselves vertical stacking. Storage bins of this last mentioned type are disclosed in U.S. Pat. Nos. 2,210,250; 738,572; 729,619; and 352,925.

SUMMARY OF THE INVENTION

In its broadest aspect the present invention provides means for freely pivoting a storage bin whereby the storage bin will normally and automatically assume a horizontal position when empty and in that position will expose the front surface thereof so that, either by a distinctive color or by reference marks on the storage bin and the cabinet therefor visual means will be provided for indicating the condition of the storage bin. When the storage bins are rady for use they are moved to a working position merely by pushing the front end thereof in a downward direction so that the contents thereof slide to the front. The bin is automatically held in the downwardly slopping position so that the contents thereof are readily accessable. When it is desired to place the bins in a storage position, that is when they are not to be used, the bins are tilted upwardly so that the contents thereof slide to the back and the bins are thereby held in their upward position. In this position at least a portion of the front surface and a portion of the bottom surface are visible from a location in front of the cabinet. Preferably the bottom surface of the storage bin is a different color than the front surface so that from the front position the two colors will be readily visible and will provide instantaneous indication that there is material in each of the bins that are tilted upwardly.

The storage bins comprising the present invention may have integral notched hanger means that are supported on pivot rods mounted in the cabinet. Alternatively, the notched hangers may be secured to the cabinet and the pivot rods secured to each bin. In either case the rods may have laterally spaced apart, annular grooves to receive the hangers and thereby prevent lateral displacement of the bins. The bottom surface of the storage bin may be flat since the material therein will slide either to the front or the back when the bin is tilted about the pivot rod. Alternatively, the bottom surface of the storage bins may be upwardly concave. In still another embodiment the bottom surface may have several transverse legs that extend upwardly. The storage bins comprising the present invention may be modified by providing either a hinged door or a sliding door on the open top surface thereof.

Accordingly it is a primary object of the present invention to provide an improved storage bin.

It is another object of the present invention to provide an improved storage bin, as described above, that automatically indicates an approximation of the quantity of the contents therein.

It is another object of the present invention to provide an improved storage bin, as described above, that is pivotly mounted on an adjustable support.

A particular object of the present invention is to provide an improved pivotly mounted storage bin that will remain in a substantially horizontal position or plane when empty and thereby provide a visual indication of that state and which may be pivoted upwardly when the bins are not to be used and downwardly when the bins are to be used, the last two positions being automatically retained by the contents of the bins themselves without additional locking means.

These and other objects, features and advantages of the invention will, in part, be pointed out with particularity, and will, in part, become obvious from the following more detailed description of the invention taken in conjunction with the accompanying drawing which forms an integral part thereof.

BRIEF DESCRIPTION OF THE DRAWING

In the various figures of the drawing like reference characters designate like parts. In the drawing:

FIG. 1 is a schematic perspective view illustrating a plurality of storage bins and a cabinet therefor comprising the present invention;

FIG. 2 is a perspective, fragmentary view illustrating a typical storage bin comprising the present invention;

FIG. 3A is a front elevational view illustrating a plurality of vertically stacked storage bins comprising this invention;

FIG. 3B is a schematic side elevational view of the storage bins shown in FIG. 3A in the empty position;

FIG. 4A is a front elevational view of a plurality of stacked bins comprising the present invention in the working position;

FIG. 4B is a schematic side elevational view of the storage bins shown in FIG. 4A;

Brief Description of the Preferred Embodiment

Figure 5A:
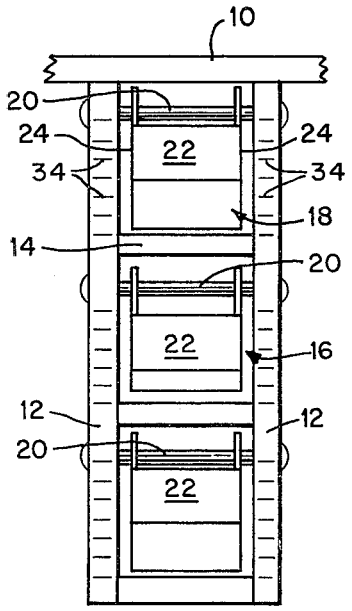
FIG. 5A is a front elevational view of a plurality of storage bins and a cabinet comprising the present invention.

Referring now to FIG. 1 there is first shown a cabinet 10 which, by means of vertical walls 12 and horizontal walls 14 is divided into a plurality of recesses 16. In each of the recesses 16 there is positioned a storage bin 18 comprising the present invention. As will be explained more fully hereinafter each storage bin 18 is supported on horizontal pivot members 20 that extends between the side walls of the cabinet 10.

Turning now to FIG. 2 there is shown in somewhat greater detail a typical one of the storage bins 18 that comprise the present invention. It will be seen that the storage bin 18 includes a front wall 22, a pair of laterally opposed, substantially parallel side walls 24, a bottom wall 26, and a rear wall 28. In this first embodiment a pair of hangers 30 are formed integraly with the side walls 40. Each of the hangers 30 includes a plurality of notches 32 so that the storage bins 18 may be supported at different positions on the rods 20.

The manner of using the present invention may best be understood by reference to FIGS. 3, 4, and 5. As shown in FIGS. 3A and 3B the storage bin 18, when empty, will, due to its pivotal mounting and balancing, remain in a substantially horizontal position so that the front surface thereof is readily visible through the recess 16 defined by two pairs of vertical walls 12 and two pairs of horizontal walls 14. Preferably, the front wall 22 of each bin 18 is provided with a distinctive color. Thus when this color is visible there will be positive indication that the storage bins 18 are empty and it will not be necessary to examine each one. A further indication that the bin is empty and is in a substantially horizontal position may be provided by means of registry marks 34 formed on the front edge of the vertical walls 12. It will be apparent that when a reference edge of each bin 18, for example the top edge of the front surface 22, is in alignment with a particular one of the registry marks, the bin 18 is empty.

To gain access to the storage bins 18 all that is necessary is to tip them downwardly with respect to the front of the cabinet 10. This position, the working position, is shown in FIG. 4a and FIG. 4B. The articles contained within the storage bin 18 will normally slide to the front thereof due to gravitational forces and will thereby hold the bins 18 in the downwardly tipped or working position. The bins 18 will not return to any other position unless they are physically moved or unless the bins 18 are completely empty at which time they will assume the position shown in FIG. 3A and in FIG. 3B. Of course, as the contents are depleted, the storage bins 18 will tend to pivot in upward direction towards the horizontal plane shown in FIG. 3A and in FIG. 3B. In doing so the top edge of the front panel 22, in combination with registry marks 34 on the walls 12 will provide a visual indication of the quantity of contents in each storage bin 18. When the storage bins 18 are in position such as shown in FIG. 4A and 4B the contents thereof will be readily accessable since the top of each storage bin 18 is open.

Figure 5B:
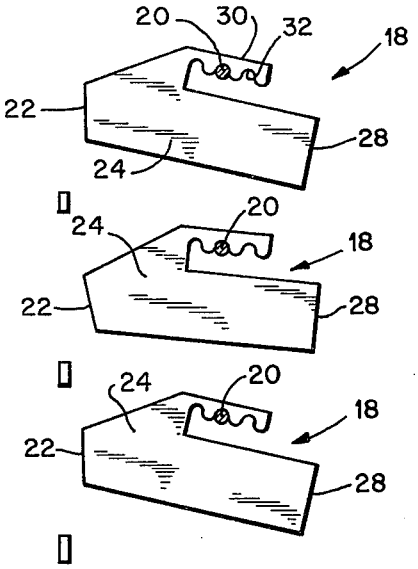
FIG. 5B is a schematic side elevational view of the storage bins shown in FIG. 5A in the storage position.

FIG. 5A and FIG. 5B illustrate the position of the storage bins 18 when they are not in use. The bins 18 are placed in the storage position merely by tilting them upwardly so that the contents thereof slide to the back. In this position at least a portion of the front surface 24 and a portion of the bottom portion 26 are visible at the recesses 16 formed by two parallel walls 12 and two parallel walls 14. Preferably, the bottom wall 26 of each bin 18 is a distinctive color that is different than the color of the front wall 22 thereof. Thus, in the storage position each bin 18 will display two colors that will readily indicate that there are articles therein. Once again a reference edge of each storage bin 18, for example the juncture between the front wall 22 and the bottom wall 26 may be used in combination with the registry marks 34 on the vertical walls 12 in order to provide a quantitative indication of the contents in each storage bin.

Figure 6:
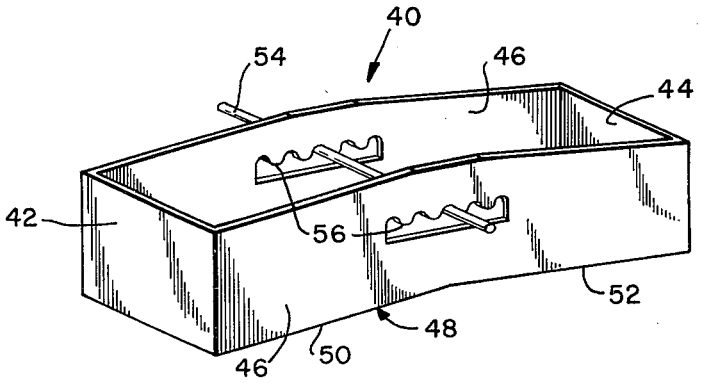
FIG. 6 is a perspective view of an alternative embodiment of the present invention.

FIG. 6 illustrates two alternative features of the present invention. The storage bin 40 shown in FIG. 6 includes a front wall 42, a rear wall 44, two spacedly opposed and substantially parallel side walls 46 and an upwardly concave bottom wall generally designated by the reference character 48. It will be noted that the bottom wall 48 slopes upwardly from the front wall 42 such as shown by the reference character 50 and also slopes upwardly from the rear wall 44 such as shown by the reference character 52 in order to define the upwardly concave bottom surface 48. This construction aids in the movement of the contents towards the front when the bins 40 are placed in the working position such as shown in FIGS. 4A and 4B and also aids in the movement of the contents to the rear when the bins 40 are placed in the storage position such as shown in FIG. 5A and in FIG. 5B.

Another modification of the present invention is also shown in FIG. 6. Whereas in the previous embodiment the hanger means that was supported on the pivot rod was integral with the storage bin, the FIG. 6 construction discloses that the pivot rod 54 may be mounted in the side walls 46 of the storage bin 40. In this event, hanger means 56 are inverted with respect to the orientation shown in the first embodiment and are made integral with a portion of the cabinet for example the vertical walls thereof. The mode of operation of the embodiment shown in FIG. 6 is the same as that previously described and shown in the first embodiment of FIGS. 1–5.

Figure 7:
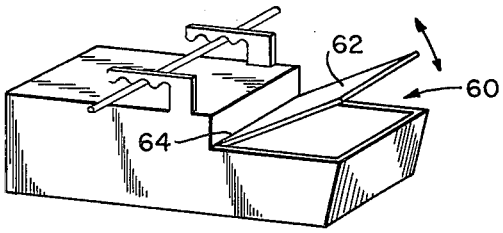
FIG. 7 is a perspective view showing one modification of the storage bin comprising this invention.
Figure 8:
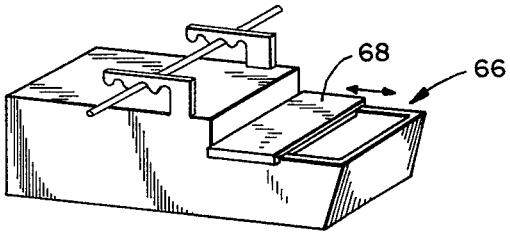
FIG. 8 is a perspective view illustrating another modification of the storage bin comprising the present invention.

FIGS. 7 and 8 illustrate alternative features of the present invention. In FIG. 7 there is shown a storage bin generally designated by the reference character 60 whose construction is substantially the same as that shown in the embodiment of FIG. 1. However, in the FIG. 7 embodiment a cover 62 is secured over the open, front end of the storage bin 60 by hinge means shown schematically by the reference character 64. In the FIG. 8 embodiment the storage bin 66 is provided with a sliding cover 68 that rides in suitable tracks (not shown) which are made integral with the side walls of the storage bins 66. Provision of a cover is advantageous when pills, capsules, medicines etc. are to be stored. The cover is a safety measure which still permits simplified dispensing of the contents of the storage bin.

Figure 9:
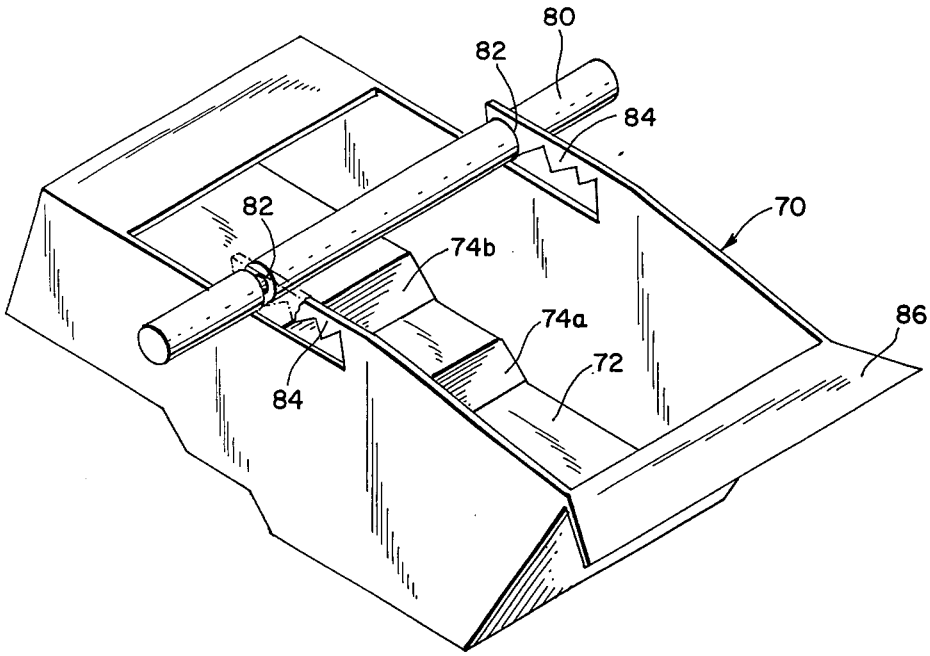
FIG. 9 is a perspective view illustrating several alternative, constructional features of this invention.

Several additional constructional features of this invention are shown in FIG. 9. First the bin 70 is provided with a bottom wall 72 that is defined in part, by a plurality of transversely extending lips 74*a*, *b* etc., each of which is directed upwardly. When there are relatively few, relatively light weight articles, such as small brads, pins, pills or the liKe remaining they will accumulate near the front of the bin because of the interference of the first lip 74*a*. In this hypothetical situation, if there are more of the same articles but still not enough to sufficiently tip down a flat bottom bin such as described earlier, the second lip 74*b* will provide the necessary interference even if the first lip 74*a* is covered by the articles. In both instances one or the other lip 74 tend to keep light weight articles towards the front of the bin.

Other alternative structures are also shown in FIG. 9. For example the rod 80 is provided with a pair of laterally spaced apart annular grooves 82 for receiving and for preventing the lateral displacement of the hangers 84 of the bin 70. In addition, a forwardly directed extension 86 is formed integrally with the bin 70 and serves as an indicator marker, in cooperation with appropriate indicia formed on the cabinet, as described hereinbefore in connection with other embodiments of this invention.

From the foregoing it will be evident that an improved storage bin has been provided for items such as screws, nails, nuts, bolts, medicines such as pills and capsules and the like. The improved storage bin permits an individual to tell at a glance, no matter how many bins are in use, approximately how much is left in the bins or if the bins are empty. Gauges on the front of the cabinet or a gauge on the front of each bin provides a quantitative measurement of the contents of the bin. To remove the bin for filling all that is necessary to lift the bin off of its pivot support. The storage bins comprising the present invention can be manufactured from many different materials such as plastic, metal, glass, and even wood. The bins can be made in many different sizes and shapes with no limitation as to the volume thereof.

The pivotally mounted storage bin comprising the present invention is constructed such that when they are empty they will hang in a generally horizontal plane. A distinctively colored front panel provides a visual indication when the empty bins are in a horizontal plane and are therefor visible. To remove articles from the bins they are merely tipped forward so that the contents thereof slide to the front and thus hold the bin in the downward position. As the bins are emptied they will, because of their weight distribution and pivot mounting, move back to the horizontal position that indicates that they are empty. If before the bins are emptied it is decided not to use the contents thereof anymore the front ends of the bins are tipped upwardly through and past the horizontal plane so that the contents thereof slide towards the rear. In this position the bins will remain inaccessable due to the positioning of the contents thereof at the back. Member 86 serves also to limit movement of the bin within a predetermined range by extending forward of the cabinet so that when the bin is tipped upwardly it will fit a horizontal member 14 above it and when tipped downwardly will fit the horizontal member 14 below it.

When in the storage position just described a portion of the bottom surface of the bins will be visible and since the bottom surfaces are preferably provided with a distinctive color different from the front panels of the bins there will be a further indication of the condition of the bins. Reference markers may be provided on the cabinet to be used in cooperation with reference points on each bin in order to quantitatively indicate the fullness of each bin. The bins may be removed for refilling very easily since they are pivotly supported on notches formed in hangers. In one embodiment of the invention the hangers are integral with each bin with the pivot member being fixed in the cabinet. In another embodiment of the invention the pivot rod is integral with each bin and the hangers are secured to the cabinet. As an added feature that facilitates the movement of the contents of the bin from the front to the back, sloping bottom walls may be provided. In addition, where security is a consideration, covers either hinged or sliding may be provided for each bin.

It is preferred that the wall of the bins be slightly tapered inwardly toward the bottom whereby the bins may be nested for shipment.

For example, the bins may be made of metal, plastic wood or cardboard and may be provided with means for mounting specimen pieces on the front of each bin.

There has been disclosed heretofore the best embodiment of the invention presently contemplated. However, it is to be understood that various changes and modifications may be made thereto without departing from the spirit of the invention.

What I claim as new and desire to secure by Letters Patent is:

1. A storage bin assembly for the type of material of which a portion may be removed at a time leaving a remainder of the material, said storage bin assembly comprising:

a. a first member in the form of an open fronted cabinet including divider means that define a plurality of recesses;

b. a plurality of second members each in the form of a bin positioned in each said recess, each said bin including a pair of spacedly opposed side walls, a bottom wall, a rear wall and a front wall having quantity indicating means thereon cooperating with said divider means for providing a visual approximation of the quantity of material remaining in each said bin; and c. support means defined by hanger means integral with said bins and rod means supported by the said cabinet; said hanger means including a plurality of opposed pairs of notches, said rod meand fitting into selected pairs of the notches and pivotly mounting each said bin in said respective recess, said hanger means being supported on said rod means such that each said bin is adapted to assume and remain in, absent an external force being applied thereto, a first, frontally tipped down working position when the material remaining is at the front end thereof, a second, substantially horizontal position when empty of the material, said second position being visibly different than said first position whereby each said bin in said first position will be at an angle with respect to said second position, the size of said angle being proportional to the quantity of material remaining in each said bin to thereby provide said visual approximation of the quantity of material remaining, each said bin being freely movable from said first position towards said second position as the quantity of material remaining is reduced and a third frontally tipped up storage position when the material remaining is at the rear end thereof, said third position being visibly different than either said first or said second positions.

2. The storage bin assembly in accordance with claim 1 wherein said indicator means comprises a distinctively colored area on said front panel.

3. The storage bin assembly in accordance with claim 1 wherein said indicator means on said front panel comprises a distinctively colored area and wherein said bottom panel further includes a differently distinctly colored area.

4. The storage bin assembly in accordance with claim 1 wherein there is further included a plurality of registry marks in vertical arrays on the front surface of said cabinet adjacent said bins whereby the extent of the contents of each said bin may be approximated depending upon the position of said bin relative to said mark.

5. The storage bin assembly in accordance with claim 4 wherein each said bin includes a forwardly directed extension arranged to cooperate with said registry marks for indicating the approximate contents of said bin.

6. The storage bin assembly in accordance with claim 1 wherein said bottom wall of said bin includes a plurality of transverse, upwardly extending lips.

7. The storage bin assembly in accordance with claim 1 wherein said rod means includes annular groove means for receiving said hanger means to thereby prevent lateral displacement of said bin.

8. The storage bin of claim 5 wherein upward and downward movement of said bin is limited by said forwardly directed extension engaging said divider means.

* * * * *